United States Patent [19]

Garcia et al.

[11] 4,326,462

[45] Apr. 27, 1982

[54] SHAPED CHARGE RETENTION AND BARRIER CLIP

[75] Inventors: Jose B. Garcia, Houston, Tex.; Michel J. Bosse-Platiere, Versailles, France

[73] Assignee: Schlumberger Technology Corporation, Houston, Tex.

[21] Appl. No.: 77,575

[22] Filed: Sep. 21, 1979

[51] Int. Cl.[3] ..... E21B 43/117; F42B 1/02

[52] U.S. Cl. ..... 102/310; 16/2; 175/4.6; 166/55.1

[58] Field of Search ..... 24/73 AS, 73 S; 248/27.3, 56; 285/162, 194, DIG. 22; 16/2; 175/4.6; 89/1 C; 102/20, 21.6, 24 HC

[56] References Cited

U.S. PATENT DOCUMENTS

| | | | |
|---|---|---|---|
| 3,078,797 | 2/1963 | Blair | 175/4.6 |
| 3,094,930 | 6/1963 | Blair | 175/4.6 |
| 3,514,129 | 5/1970 | Holdren | 285/162 |
| 3,739,723 | 6/1973 | Hakala | 175/4.6 X |
| 3,991,446 | 11/1976 | Mooney et al. | 16/2 X |
| 4,011,815 | 3/1977 | Garcia | 175/4.6 X |
| 4,137,602 | 2/1979 | Klumpp | 285/194 X |

OTHER PUBLICATIONS

Union Carbide Brochure–"Introducing RADEL Polyphenylsufone", (1977).

*Primary Examiner*—David H. Brown

[57] ABSTRACT

A shaped charge retention and barrier clip according to the invention includes a barrier ring means for preventing damage to the interior of a perforating gun, and retention means for securing the barrier ring means and the shaped charge to a carrier strip disposed in the perforating gun.

8 Claims, 4 Drawing Figures

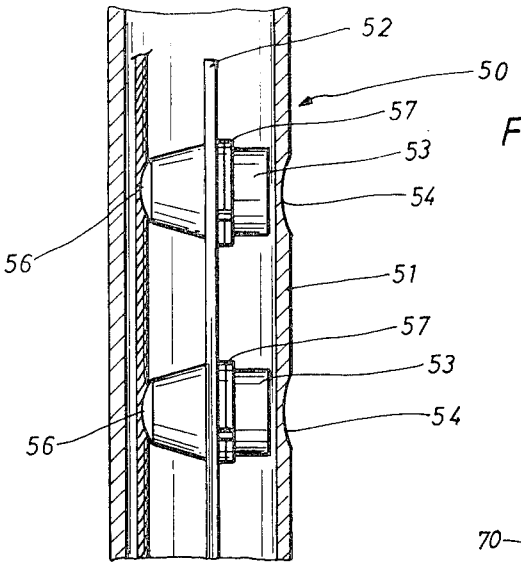
FIG. 1
FIG. 3
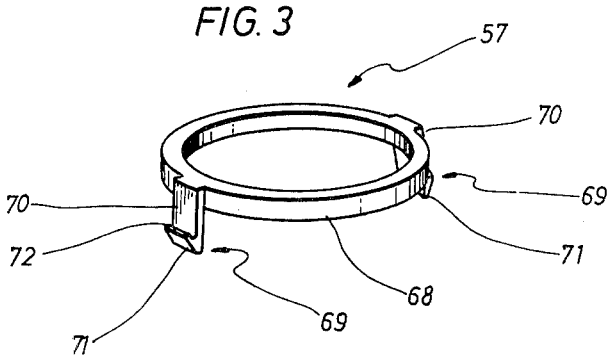
FIG. 2
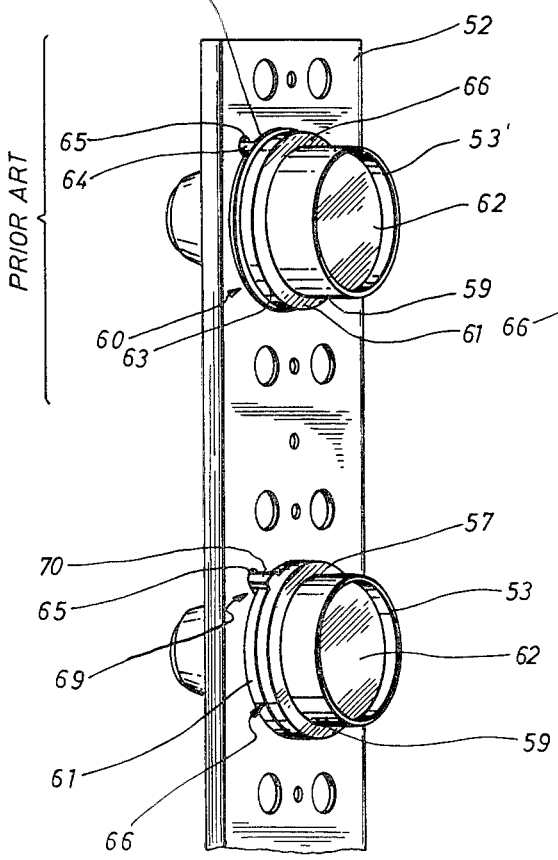
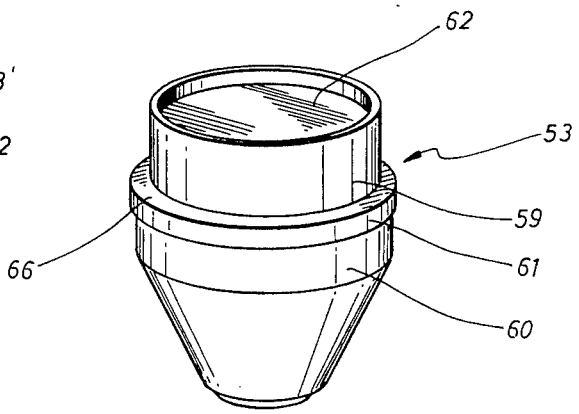
FIG. 4

SHAPED CHARGE RETENTION AND BARRIER CLIP

BACKGROUND OF THE INVENTION

1. Field of the Invention

The invention relates to a shaped charge retention and barrier clip for use in a shaped charge perforating gun.

2. Description of the Prior Art

The perforating guns most commonly used in present-day wireline service operations are typically comprised of an elongated fluid-tight body or so-called "enclosed carrier" which houses one or more shaped explosive charges and the necessary accessories for detonating these charges from the surface. A common type of enclosed carrier has heavy, explosion-resistant walls so that the carrier can be retrieved from the hole.

The shaped charges are usually disposed upon a carrier strip which is inserted into the carrier. Heretofore, the shaped charges have been secured to the carrier strip by means of a brass retainer clip which was frictionally secured to the shaped charge, and then placed in the carrier strip. Additionally, a rubber O-ring has been associated with the shaped charge to provide protection to the interior wall of the carrier upon detonation of the shaped charge, whereby the carrier could be retrieved.

The use of the previously described brass retaining clip and rubber O-ring in association with the shaped charge suffered from the following disadvantages. The use of the brass retainer clip did not provide secure retention of the shaped charge in the carrier strip, since there was a certain degree of wobbling of the shaped charge with respect to the carrier strip once the shaped charge was inserted in the carrier strip. The wobbling of the shaped charge with respect to the strip could cause misalignment between the charge and associated reduced thickness wall portion of the carrier, thereby contributing to decreased performance. Additionally, some force had to be applied to mount the brass retainer clip upon the shaped charge because of the friction fit between those two components. The application of such force could result in the hands of the individual assembling the ring upon the shaped charge to suffer minor cuts and abrasions. The necessity of the friction fit between the shaped charge and the brass retainer ring also required small manufacturing tolerances, whereby the friction fit could be obtained in order to avoid having a shaped charge slide out of the brass retainer ring. Since large-scale wireline service operations require a large number of shaped charges, and related components, over the years the cost of manufacturing the brass retainer clips and the O-rings have risen, as well as the rise in the cost of labor necessary to assemble the shaped charge in the carrier strip. These rising costs have presented an economical problem associated with the prior art brass retainer clip and rubber O-ring used in conjunction with conventional shaped charges and carrier strips.

Accordingly, prior to the development of the present invention, there has been no shaped charge retaining device which: included protection for the interior walls of a retrievable enclosed carrier and provided a secure connection of the shaped charge to the carrier strip without excessive wobble of the shaped charge with respect to the carrier strip; was easy to use in mounting the shaped charge to the carrier strip; and was low in cost to manufacture and use. Therefore, the art has sought an efficient and inexpensive shaped charge retention and barrier clip which is also safe when using it to provide a secure connection of a shaped charge to a carrier strip.

SUMMARY OF THE INVENTION

In accordance with the invention the foregoing benefits have been achieved through the present shaped charge retention and barrier clip. The shaped charge retention and barrier clip of the present invention comprises: a barrier ring means for preventing damage to the interior of a perforating gun caused by a shaped charge upon detonation thereof; and retention means integral with said barrier ring means, and depending and extending outwardly therefrom, for securing the barrier ring means and the shaped charge to the carrier strip.

A feature of the present invention resides in the fact that the retention and barrier clip is molded from a high-temperature resistant polymer. A further feature of the present invention is that the retention means includes at least two wedge members spaced from the barrier ring means and adapted for engaging the carrier strip.

The present invention also includes an improvement in a perforating gun containing a shaped charge disposed in a carrier strip, wherein: the shaped charge has a generally cylindrical cross-sectional configuration and a circumferential raised portion or shoulder; the carrier strip has an opening therein which receives the shaped charge and substantially conforms to the cross-sectional configuration of the shaped charge: and the circumferential raised portion of the shaped charge abuts and overlies the carrier strip. The improvement comprises a shaped charge retention and barrier clip which includes: a barrier ring means for preventing damage to the interior of the perforating gun caused by the shaped charge upon detonation thereof and adapted for resting upon the circumferential raised portion of the shaped charge; and retention means for securing the barrier ring means and the shaped charge to the carrier strip, wherein the retention means is integral with the barrier ring means and depends and extends outwardly therefrom and is adapted for overlying the circumferential raised portion of the shaped charge and for engaging the carrier strip to secure the shaped charge and the barrier ring means to the carrier strip.

The present invention further includes a shaped charge carrier assembly for use in a perforating gun comprising: at least one shaped charge having a generally cylindrical cross-sectional configuration and a circumferential raised portion; a carrier strip for holding the shaped charge and having at least one opening therein which substantially conforms to the cross-sectional configuration of the shaped charge and said carrier strip is in an abutting relationship with the raised portion of the shaped charge; and a shaped charge retention and barrier clip which includes a barrier ring means for preventing damage to the interior of the perforating gun caused by the shaped charge upon detonation thereof and retention means. The barrier ring means is disposed upon the circumferential raised portion of the shaped charge. The retention means, for securing said barrier ring means and said shaped charge to said carrier strip, is integral with said barrier ring means and depends and extends outwardly therefrom.

The retention means overlies the circumferential raised portion of the shaped charge in engagement with the barrier strip to secure the shaped charge and the barrier ring means to the carrier strip.

The shaped charge retention barrier clip of the present invention, when compared with previously proposed prior art retention clips has the advantages of ease of use and assembly, is inexpensive to manufacture and assemble, and provide a secure fit of the shaped charge in the carrier strip, without excessive wobble of the shaped charge.

BRIEF DESCRIPTION OF THE DRAWINGS

In the drawings:

FIG. 1 is a partial cross-sectional view of a portion of a perforating gun provided with the shaped charge retention and barrier clip of the present invention;

FIG. 2 is a perspective view of a carrier strip with two shaped charges mounted therein, the top portion illustrating the prior art and the lower portion illustrating the shaped charge retention and barrier clip of the present invention;

FIG. 3 is a perspective view of the shaped charge retention and barrier clip of the present invention; and FIG. 4 is a perspective view of a typical shaped charge for use with the retention and barrier clip of the present invention.

While the invention will be described in connection with the preferred embodiment, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

In FIG. 1, a portion of a conventional, perforating gun 50 is shown to include a reusable tubular housing 51 formed of a length of steel tubing having an explosion-resistant wall. Perforating gun 50 has at its upper end (not shown) a conventional head (not shown) suitably arranged to dependently support an elongated metal carrier strip 52 having openings therein arranged at spaced intervals therealong for receiving a corresponding number of typical shaped explosive charges 53. Each of the shaped charges 53 are mounted on the support, or carrier, strip 52 and preferably are faced toward reduced-thickness wall portions of housing 51, as at 54. To controllably detonate the charges 53, the perforating gun 50 has a charge-detonating train which includes a length of detonating cord 55 that is successively positioned in detonating proximity of each shaped charge 53 as at 56. The shaped charge retention and barrier clip 57 of the present invention is shown securing shaped charges 53 to carrier strip 52.

Turning now to FIG. 2, a typical carrier strip 52 is shown in greater detail, with shaped charges 53 and 53' mounted therein. Shaped charges 53 and 53' are identical in construction; however, shaped charge 53' at the top of FIG. 2 is secured to carrier strip 52 by the prior art brass retainer clip 58, whereas shaped charge 53 is secured to carrier strip 52 by the retention and barrier clip 57 of the present invention.

With reference to the upper portion of FIGS. 2 and 4, the prior art brass retainer clip 58 will be described. It is seen that shaped charge 53 has a generally cylindrical cross-sectional configuration, including cylindrical upper portion 59 and lower portion 60, and a circumferential raised portion, or rib, 61. It should be noted that the diameter of the top portion 59 of shaped charge 53 is smaller than the diameter of the lower portion 60 of shaped charge 53. Contained within the shaped charge 53 is a suitable explosive compound 62.

With reference now to FIG. 2, it is seen that the prior art brass retainer clip 58 is frictionally mounted about the lower cylindrical portion 60 of shaped charge 53', and the lower surface of rib 61 abuts against brass retainer clip 58 as at 63. Carrier strip 52 is provided with an opening (not shown) therein which receives the shaped charge 53' and the opening substantially conforms to the cross-sectional configuration of the lower portion 60 of shaped charge 53'. The diameter of the prior art brass retainer clip 58 is slightly larger than the opening in carrier strip 52, whereby brass retainer clip 58 overlies the opening and abuts against carrier strip 52. Brass retainer ring 58 is provided with two downwardly depending legs, one of which is shown at 64 and passes through a small semicircular opening 65 formed in carrier strip 52 adjacent the opening which accommodates lower portion 60 and charge 53'. Legs 64 of the prior art brass retainer ring 58 would either be flexed inwardly to allow their insertion through holes 65, whereby they would spring back and secure shaped charge 53' in the opening of carrier strip 52, or alternatively, after legs 64 were inserted through holes 65, legs 64 would be bent outwardly to secure shaped charge 53' in carrier strip 52.

The prior art brass retainer ring 58 was also used in conjunction with a rubber O-ring (for clarity not shown) which was used to isolate the explosion from shaped charge 53' from the interior surface of housing 51. The O-ring is placed about the upper portion 59 of shaped charge 53' and is in abutting relationship with the top surface 66 of the raised portion or shoulder 61 of the shaped charge 53'. Of course, the interior of the O-ring (not shown) is also in abutting relationship with the upper portion 59 of shaped charge 53'.

Referring now to the lower portion of FIG. 2, in connection with shaped charge 53, and FIG. 3, the shaped charge retention and barrier clip 57 of the present invention will be described in greater detail. Retention and barrier clip 57 includes a barrier ring means 68 for preventing damage to the interior wall of the perforating gun 50 caused by the shaped charge 53 upon detonation of the explosive charge compound 62. Barrier ring means 68 serves to isolate and prevent the shaped charge 53, and in particular the upper portion 59 of shaped charge 53 from contacting and damaging the interior surface of housing 51 upon detonation of explosive compound 62. Barrier ring 68 has an inner diameter which substantially corresponds with the outer diameter of the upper portion 59 of shaped charge 53, and an outer diameter which substantially corresponds to the outer diameter of rib 61 of shaped charge 53. In the preferred embodiment, the cross-sectional configuration of ring 68 is a square; however, other cross-sectional configurations would be satisfactory. As shown in the lower portion of FIG. 2, barrier ring means 68 rests upon the circumferential raised portion or shoulder 61 of shaped charge 53 in an abutting relationship with the upper portion 59 of shaped charge 53 and the upper surface 66 of circumferential raised portion 61 of shaped charge 53.

Still referring to the lower portion of FIG. 2 and FIG. 3, it is seen that depending and extending outwardly from barrier ring 68 are retention means 69 for securing barrier ring 68 and shaped charge 53 to carrier strip 52. Retention means 69 is formed integral with ring 68, and includes two downwardly and outwardly extending leg portions 70, and two wedge members 71 which are spaced from barrier ring 68 and are adapted for engaging the underside of carrier strip 52. Wedge member 71 could be designed with a different shape, such as a semicircle or oval, etc. It should be pointed out that downwardly and outwardly extending legs 70 overlie the circumferential raised portion 61 of the shaped charge 53 and the outer diameter of barrier ring 68, which substantially corresponds to the outer diameter of rib 61, slightly exceeds the diameter of the opening (not shown) in carrier strip 52.

As shaped charge 53, with the retention and barrier clip 57 placed thereon, is placed in the opening provided in carrier strip 52, wedge members 71 contact semicircular openings 65 in carrier strip 52, whereby the normally outwardly extending legs 70 are inwardly flexed until wedge members 71 clear openings, or holes, 65. Preferably, legs 70 are outwardly disposed at a 10° angle. After wedge members 71 pass through holes 65 in carrier strip 52, the normally outwardly extending legs 70 spring back, whereby the retention surface 72, disposed behind wedge member 71 engages the underside of carrier strip 52, thus securing barrier ring means 68 and shaped charge 53 to the carrier strip 52.

Although in the preferred embodiment retention means 69 includes two downwardly and outwardly extending legs 70 and two wedge members 71 integral therewith, which are disposed on opposite sides of barrier ring 68, it should of course be understood that additional legs 70 and wedge members 71 could be provided. Preferably, the shaped charge retention and barrier clip 57 of the present invention is molded from a high-temperature resistant polymer in order to obtain an easily manufactured and inexpensive clip 57 that can withstand the high temperatures encountered in the borehole. One example of such a polymer is RADEL Polyphenylsulfone; however, any high-temperature resistant polymer could be used which has the requisite high-temperature resistant characteristics, as well as a suitable elongation characteristic whereby snap-fitting of legs 70 and wedge member 71 can be accomplished.

It is to be understood that the invention is not limited to the exact details of construction, operation, or exact materials or embodiment shown and described, as obvious modifications and equivalents will be apparent to one skilled in the art, and the invention is therefore to be limited only by the scope of the appended claims.

We claim:

1. In a perforating gun containing a shaped charge disposed in a carrier strip, the shaped charge having a generally cylindrical cross-sectional configuration and a circumferential raised portion, the carrier strip having a first opening therein which receives the shaped charge and substantially conforms to the cross-sectional configuration of the shaped charge and at least one second opening adjacent said first opening, and the circumferential raised portion of the shaped charge abuts and overlies the carrier strip, the improvement which comprises:

a shaped charge retention and barrier clip which includes:

a barrier ring means for preventing damage to the interior of the perforating gun, caused by the shaped charge upon detonation thereof, and adapted for resting upon the circumferential raised portion of the shaped charge; and retention means for securing said barrier ring means and said shaped charge to said carrier strip, said retention means being integral with said barrier ring means and depends and extends outwardly therefrom, and adapted for overlying the circumferential raised portion of the shaped charge and for passing through the second opening in the carrier strip and engaging the carrier strip to secure the shaped charge and the barrier ring means to the carrier strip.

2. The improvement of claim 1 wherein the retention and barrier clip is molded from a high-temperature resistant polymer.

3. The improvement of claim 1 wherein said retention means includes at least two wedge members spaced from the barrier ring means and adapted for engaging the carrier strip.

4. The improvement of claim 3 wherein said wedge members of the retention means are disposed on opposite sides of the barrier ring means.

5. A shaped charge carrier assembly for use in a perforating gun comprising:

at least one shaped charge having a generally cylindrical cross-sectional configuration and a circumferential raised portion;

a carrier strip for holding the shaped charge and having at least one first opening therein which substantially conforms to the cross-sectional configuration of the shaped charge and at least one second opening adjacent said first opening, and said carrier strip being in an abutting relationship with the raised portion of said shaped charge; and a shaped charge retention and barrier clip which includes a barrier ring means for preventing damage to the interior of the perforating gun caused by the shaped charge upon detonation thereof, said barrier ring means being disposed upon the circumferential raised portion of the shaped charge, and retention means for securing said barrier ring means and said shaped charge to said carrier strip, said retention means being integral with said barrier ring means and depending and extending outwardly therefrom, said retention means overlying the circumferential raised portion of the shaped charge and passing through the second opening in the carrier strip and in engagement with the carrier strip to secure the shaped charge and the barrier ring means to the carrier strip.

6. The shaped charge carrier assembly of claim 5 wherein the retention and barrier clip is molded from a high-temperature resistant polymer.

7. The shaped charge carrier assembly of claim 5 wherein said retention means includes at least two wedge members spaced from the barrier ring means and in engagement with the carrier strip.

8. The shaped charge carrier assembly of claim 7 wherein said wedge members of the retention means are disposed on opposite sides of the barrier ring means.

* * * * *